US009038498B2

(12) United States Patent
Inuzuka et al.

(10) Patent No.: US 9,038,498 B2
(45) Date of Patent: May 26, 2015

(54) ACCELERATOR DEVICE

(71) Applicant: DENSO CORPORATION, Kariya, Aichi-pref. (JP)

(72) Inventors: Yoshinori Inuzuka, Okazaki (JP); Masahiro Makino, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/153,458

(22) Filed: Jan. 13, 2014

(65) Prior Publication Data

US 2014/0298948 A1 Oct. 9, 2014

(30) Foreign Application Priority Data

Apr. 4, 2013 (JP) ..... 2013-78713

(51) Int. Cl.
*G05G 1/30* (2008.04)
*G05G 1/44* (2008.04)
*G05G 5/03* (2008.04)

(52) U.S. Cl.
CPC ..... *G05G 1/44* (2013.01); *Y10T 74/20534* (2015.01); *G05G 5/03* (2013.01)

(58) Field of Classification Search
CPC ..... G05G 1/30; G05G 1/405; G05G 5/03; Y10T 74/2054; Y10T 74/20534
USPC ..... 74/512–514, 560
See application file for complete search history.

(56) References Cited

U.S. PATENT DOCUMENTS

| | | | | |
|---|---|---|---|---|
| 8,281,685 | B2 * | 10/2012 | Makino | 74/512 |
| 8,539,858 | B2 * | 9/2013 | Saito et al. | 74/513 |
| 2007/0180946 | A1 | 8/2007 | Makino | |

FOREIGN PATENT DOCUMENTS

| | | | |
|---|---|---|---|
| JP | 2001-071784 | A | 3/2001 |
| JP | 2006-032712 | A | 2/2006 |
| JP | 2007-213332 | A | 8/2007 |
| JP | 2009-023554 | A | 2/2009 |

OTHER PUBLICATIONS

Machine translation of JP 2001-071784 A obtained on Feb. 7, 2015.*
Office Action issued Jan. 5, 2015 in corresponding JP Application No. 2013-078713 (with English translation).

* cited by examiner

*Primary Examiner* — Thomas R Hannon
*Assistant Examiner* — Adam D Rogers

(57) ABSTRACT

An accelerator pedal is supported by a support member. A biasing member biases the accelerator pedal to the full close position. A resistance application unit increases a frictional force to increase a rotational resistance applied to the accelerator pedal, as a rotation angle of the accelerator pedal increases. A slidable portion is mounted to the support member and slidable on the accelerator pedal. A first latch portion and a second latch portion define an interspace therebetween in a rotational direction. The support member includes a rotation restrictive projection fitted between the first latch portion and the second latch portion.

6 Claims, 7 Drawing Sheets

ACCELERATOR DEVICE

CROSS REFERENCE TO RELATED APPLICATION

This application is based on reference Japanese Patent Application No. 2013-78713 filed on Apr. 4, 2013, the disclosure of which is incorporated herein by reference.

TECHNICAL FIELD

The present disclosure relates to an accelerator device.

BACKGROUND

A known accelerator device has an electronic configuration to cause a sensor to detect a depression quantity of an accelerator pedal and to transmit an electric signal, which represents the depression quantity, to an electronic control unit. Patent Document 1 discloses an accelerator device. The accelerator device includes a frictional member, which is equipped between a pedal arm of an accelerator pedal and a spring rotor. The frictional member has an annular portion and a rotation restrictive projected portion. The annular portion is slidable relative to the pedal arm. The rotation restrictive projected portion is projected from the annular portion outward in the radial direction. The projected portion has a tip end, which is fitted to a recessed portion formed in a wall of a housing to restrict relative displacement in the rotational direction.

(Patent Document 1)

Publication of Unexamined Japanese Patent Application No. 2006-032712 It is noted that, each of components of the accelerator device increases and decreases in size with change in temperature of an operation environment. In general, the frictional member is formed of a resin material, which is relatively soft, and the housing is formed of a resin material, which is relatively hard. Further in general, the relatively soft resin material has a coefficient of linear expansion greater than a coefficient of linear expansion of the relatively hard resin material. Therefore, the projected portion of the frictional member expands under an operation environment at high temperature, such that the projected portion is urged onto the wall of the housing. After the projected portion is continually urged onto the wall of the housing, the projected portion causes a creep strain. Consequently, the projected portion of the frictional member reduces in size at a contact portion at which the projected portion is in contact with the wall of the housing. As a result, when the operation environment decreases to a relatively low temperature, a gap may be formed between the projected portion of the frictional member and the wall of the housing. Thus, even when a driver depresses the accelerator pedal, depression force may not appropriately increase in the beginning of the depression due to the gap. Consequently, the formation of the gap may impair an operational feeling of the accelerator pedal.

SUMMARY

It is an object of the present disclosure to produce an accelerator device, which is configured to maintain an operational feeling of an accelerator pedal.

According to an aspect of the present disclosure, an accelerator device comprises a support member attachable to a vehicle body. The accelerator device further comprises an accelerator pedal supported by the support member and rotatable from a full close position to a full open position. The accelerator device further comprises a biasing member configured to bias the accelerator pedal to the full close position. The accelerator device further comprises a frictional member located between a first member and a second member, the frictional member mounted to the first member and slidable on the second member. The first member is one of the support member and the accelerator pedal. The second member is an other of the support member and the accelerator pedal. The accelerator device further comprises a resistance application unit configured, as a rotation angle of the accelerator pedal increases from the full close position, to increase a frictional force between the second member and the frictional member and to increase a rotational resistance applied from the frictional member to the accelerator pedal. The frictional member includes a slidable portion, a first latch portion, and a second latch portion. The slidable portion is slidable on the second member. The first latch portion and the second latch portion define an interspace therebetween in a rotational direction.

The first member includes a rotation restrictive projection fitted between the first latch portion and the second latch portion.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

As follows, embodiments of the present disclosure will be described with reference to drawings.

First Embodiment

Figure 1:
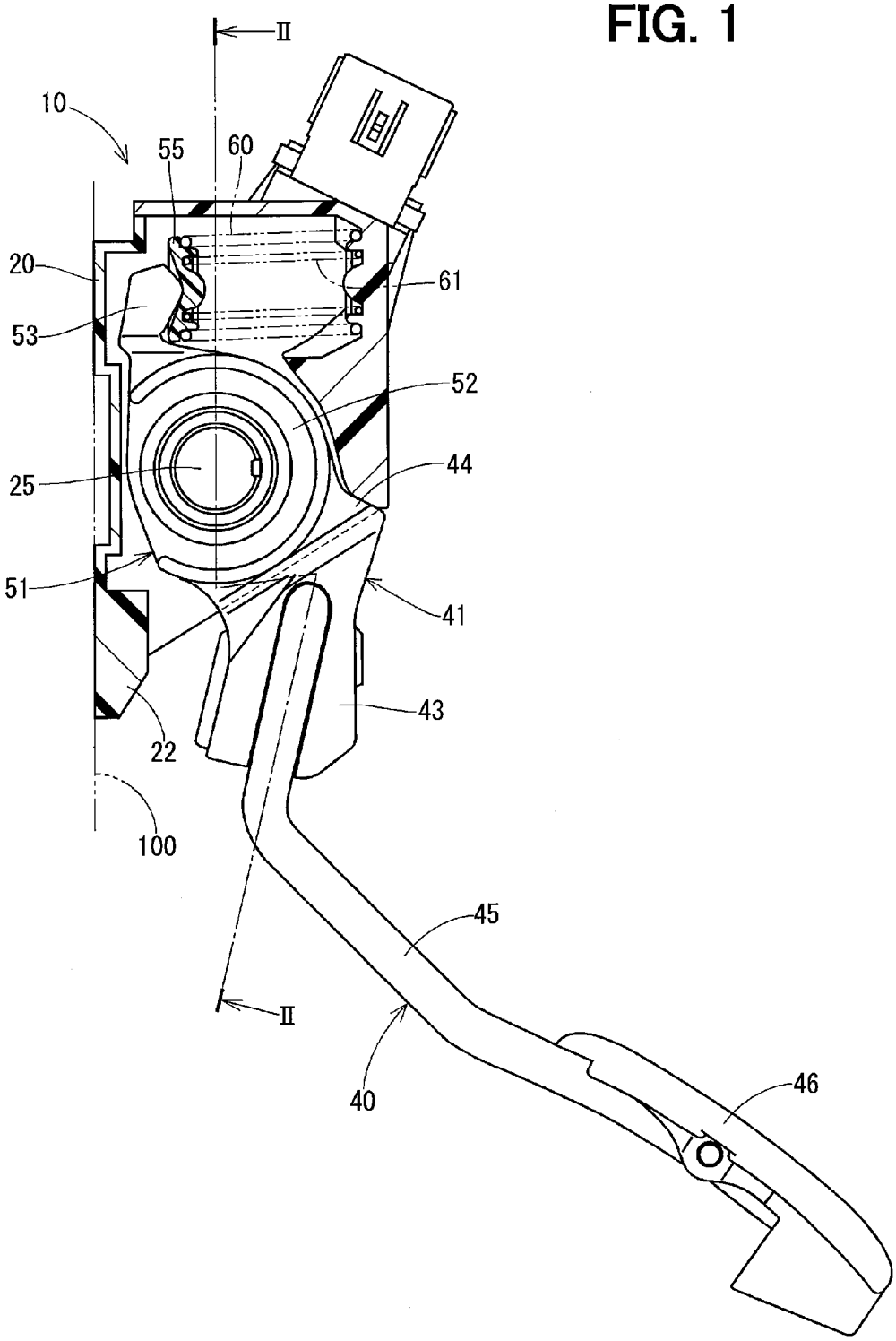
FIG. 1 is a partial sectional view showing an accelerator device according to a first embodiment of the present disclosure.

FIG. 1 shows an accelerator device according to a first embodiment of the present disclosure. An accelerator device 10 is an input device operated by a driver in order to control an operating state of an engine of a vehicle (one shown). The accelerator device 10 has an electronic configuration to transmit an electric signal to an electronic control unit (not shown). The electric signal represents a depression quantity of an accelerator pedal 40. The electronic control unit manipulates a throttle valve according to an electric signal, which is transmitted from the accelerator device 10.

First, a configuration of the accelerator device 10 will be described with reference to FIG. 1 and FIG. 2. FIG. 1 and FIG.

2 show a positional relation of the accelerator device 10 mounted to a vehicle body 100. In the following description, the top and bottom direction of the accelerator device 10, which is mounted to the vehicle body 100, corresponds to a vertical direction.

The accelerator device 10 includes a housing (support member) 20, a shaft 25, a rotational angle sensor 30, the accelerator pedal 40, a first spring 60, a second spring 61, a first frictional member 65, and a second frictional member 66. The housing 20 may function as a support member.

The housing 20 is a tubular member extended in the vertical direction. The housing 20 is integrally formed with mountable portions 21 and an open-side stopper 22. The mountable portions 21 may be fixed to the vehicle body 100 by using fasteners such as bolts. The open-side stopper 22 restricts rotation of the accelerator pedal 40 in an accelerator open direction at a full open position. The shaft 25 is rotatably supported by the housing 20 at both ends. The shaft 25 has an accommodation hole 26 at one end. The accommodation hole 26 is for accommodating a detection unit of the rotational angle sensor 30.

The rotational angle sensor 30 includes a magnetism detection element 31 and magnets 32 and 33. The magnetism detection element 31 is equipped to a center of the shaft 25 and located in the accommodation hole 26. The magnets 32 and 33 are fixed to a wall defining the accommodation hole 26. The magnets 32 and 33 interpose the magnetism detection element 31 therebetween. A density of magnetic flux, which passes through the magnetism detection element 31, changes with rotation of the shaft 25. The magnetism detection element 31 sends an external electronic control unit an electric signal according to the density of the magnetic flux passing therethrough.

The accelerator pedal 40 includes an operational member 41 and a restoration member 51. The operational member 41 includes a pedal rotor 42, a coupling portion 43, a close-side stopper 44, a lever 45, and a pad 46. The pedal rotor 42 is fitted to the shaft 25. The coupling portion 43 is projected from the pedal rotor 42 downward. The close-side stopper 44 restricts rotation of the accelerator pedal 40 in an accelerator close direction at a full close position. The lever 45 is connected with the coupling portion 43. The pad 46 is fixed to a tip end of the lever 45. The pedal rotor 42 has multiple first inclined teeth 47. Each of the first inclined teeth 47 protrudes toward the return rotor 52 of the restoration member 51 increasingly in the accelerator close direction.

The restoration member 51 includes a return rotor 52 and a spring latch portion 53. The return rotor 52 is fitted to the shaft 25 such that the return rotor 52 is rotatable relative to the shaft 25. The spring latch portion 53 is extended from the return rotor 52 toward an upper portion of an internal space of the housing 20. The return rotor 52 has multiple second inclined teeth 54. Each of the second inclined teeth 54 is projected toward the pedal rotor 42 increasingly in the accelerator open direction.

A spring holder 55 is attached to the spring latch portion 53 of the restoration member 51. The first spring 60 and the second spring 61 are equipped between the spring holder 55 and the housing 20 to bias the restoration member 51 in the accelerator close direction. The first spring 60 and the second spring 61 may function as a biasing member. The first frictional member 65 is equipped between the pedal rotor 42 and the housing 20. The second frictional member 66 is equipped between the return rotor 52 and the housing 20.

Figure 3:
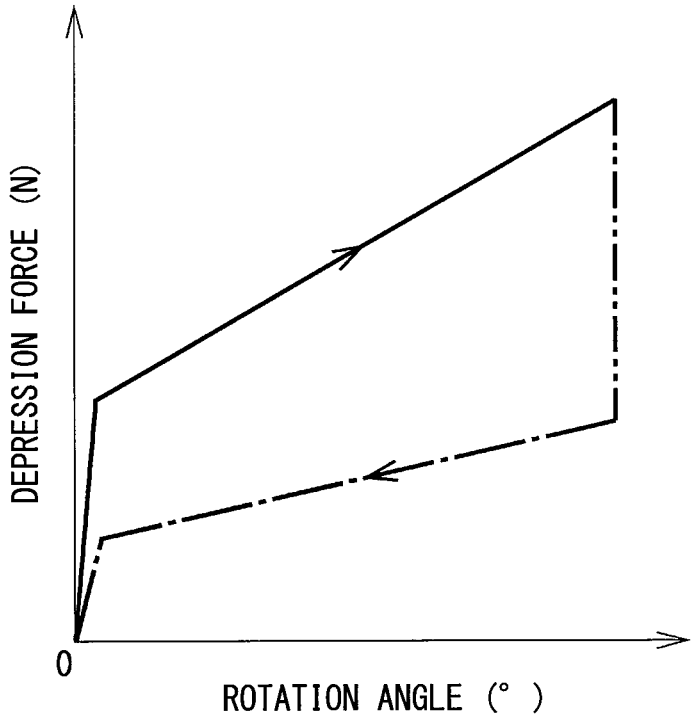
FIG. 3 is a graph showing a characteristic representing a relation between a depression force of an accelerator pedal of the accelerator device and a rotation angle of the accelerator pedal.

The operational member 41 receives a torque, and the torque is transmitted to the return rotor 52 via the first inclined tooth 47 and the second inclined tooth 54 in this order. At this time, the first inclined tooth 47 and the second inclined tooth 54 apply a biasing force to the pedal rotor 42 and the return rotor 52, such that the pedal rotor 42 and the return rotor 52 are separated from each other in an axial direction. The first inclined tooth 47 and the second inclined tooth 54 apply the biasing force increasingly as a rotation angle increases from the full close position of the operational member 41. Thus, at this time, the first frictional member 65 and the second frictional member 66 are in friction contact with the housing 20 to bias a rotational resistance to the pedal rotor 42 and the return rotor 52. Together with the biasing force of the first spring 60 and the second spring 61, the rotational resistance is transmitted to the operational member 41. As shown by a solid line in FIG. 3, the rotational resistance acts such that a depression force increases when the accelerator pedal 40 is depressed to increase the rotational angle. As shown by a dashed-dotted line in FIG. 3, the rotational resistance acts such that the depression force decreases when the accelerator pedal 40 is returned to decrease the rotational angle. The first inclined tooth 47 and the second inclined tooth 54 may function as a resistance application unit to apply a rotational resistance to the operational member 41 according to the rotation angle of the pedal rotor 42.

Figure 4:
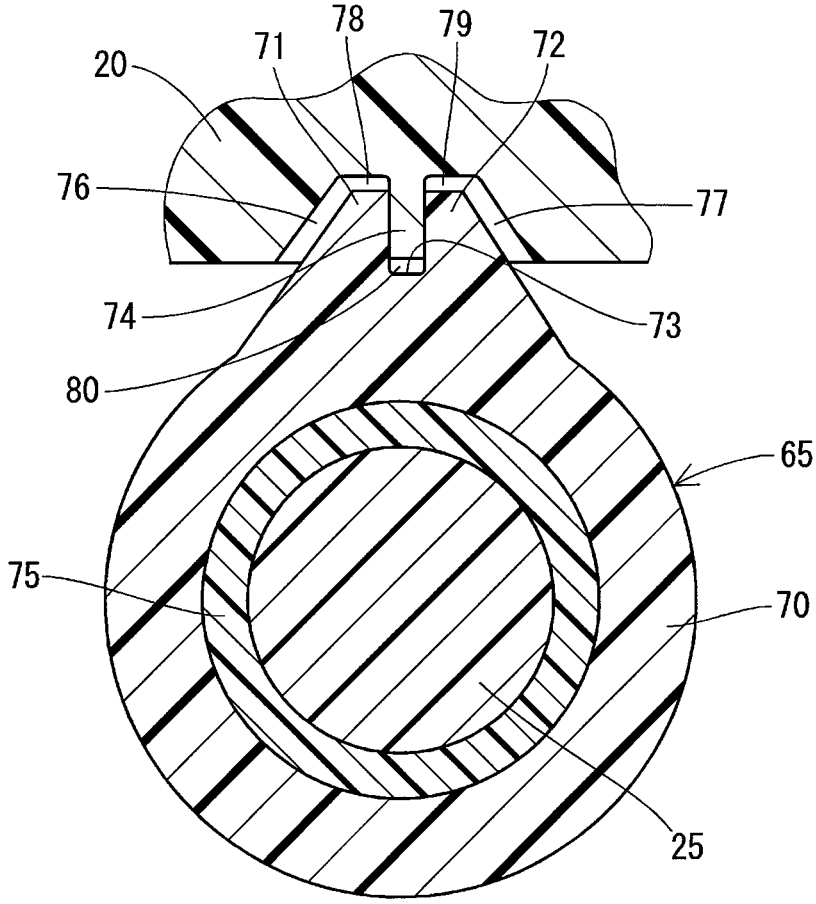
FIG. 4 is a sectional view taken along a line IV-IV in FIG. 2.

Subsequently, a configuration of the accelerator device 10 will be described with reference to FIGS. 1 to 6. As shown in FIG. 2 and FIG. 4, the first frictional member 65 has a slidable portion 70, a first latch portion 71, and a second latch portion 72. The slidable portion 70 is in an annular shape and is slidable relative to the return rotor 52. The first latch portion 71 and the second latch portion 72 are distant from each other in the rotational direction. The first latch portion 71 and the second latch portion 72 are projected from the slidable portion 70 outward in the radial direction. The first latch portion 71 and the second latch portion 72 are connected to each other at base ends. The first latch portion 71 and the second latch portion 72 form a fitting groove (interspace) 73 therebetween. The fitting groove 73 is in a notch shape.

The housing 20 has a rotation restrictive projection 74. The rotation restrictive projection 74 is fitted in the fitting groove 73, which is formed between the first latch portion 71 and the second latch portion 72 of the first frictional member 65. In the present embodiment, the projection 74 is press-fitted in the fitting groove 73. The housing 20 has a latch projected portion 75, which is in an annular shape. The latch projected portion 75 is fitted to the slidable portion 70 of the first frictional member 65 and located inside the slidable portion 70 in the radial direction. In the present embodiment, the latch projected portion 75 is press-fitted in the slidable portion 70. In the configuration including the first frictional member 65, the housing 20, and the accelerator pedal 40, the housing 20 may function as a first member, and the accelerator pedal 40 may function as a second member.

A clearance (first rotational clearance) 76 is formed on the opposite side of the first latch portion 71 of the first frictional member 65 from the rotation restrictive projection 74. The clearance 76 allows expansion of the first latch portion 71 in the rotational direction. A clearance (second rotational clearance) 77 is formed on the opposite side of the second latch portion 72 of the first frictional member 65 from the rotation restrictive projection 74. The clearance 77 allows expansion of the second latch portion 72 in the rotational direction. A clearance (first radial clearance) 78 resides on the outside of the first latch portion 71 of the first frictional member 65 in the radial direction. The clearance 78 allows expansion of the first latch portion 71 outward in the radial direction. A clearance (second radial clearance) 79 resides on the outside of the second latch portion 72 of the first frictional member 65 in the radial direction. The clearance 79 allows expansion of the second latch portion 72 outward in the radial direction. The clearances 76, 77, 78, and 79 are the same space and belong to a common clearance. The first frictional member 65 has a connection portion at which the first latch portion 71 and the second latch portion 72 are connected to each other, and a clearance 80 resides on the outside of the connection portion in the radial direction. The clearance 80 allows expansion of the connection portion and the slidable portion 70 outward in the radial direction.

Figure 2:
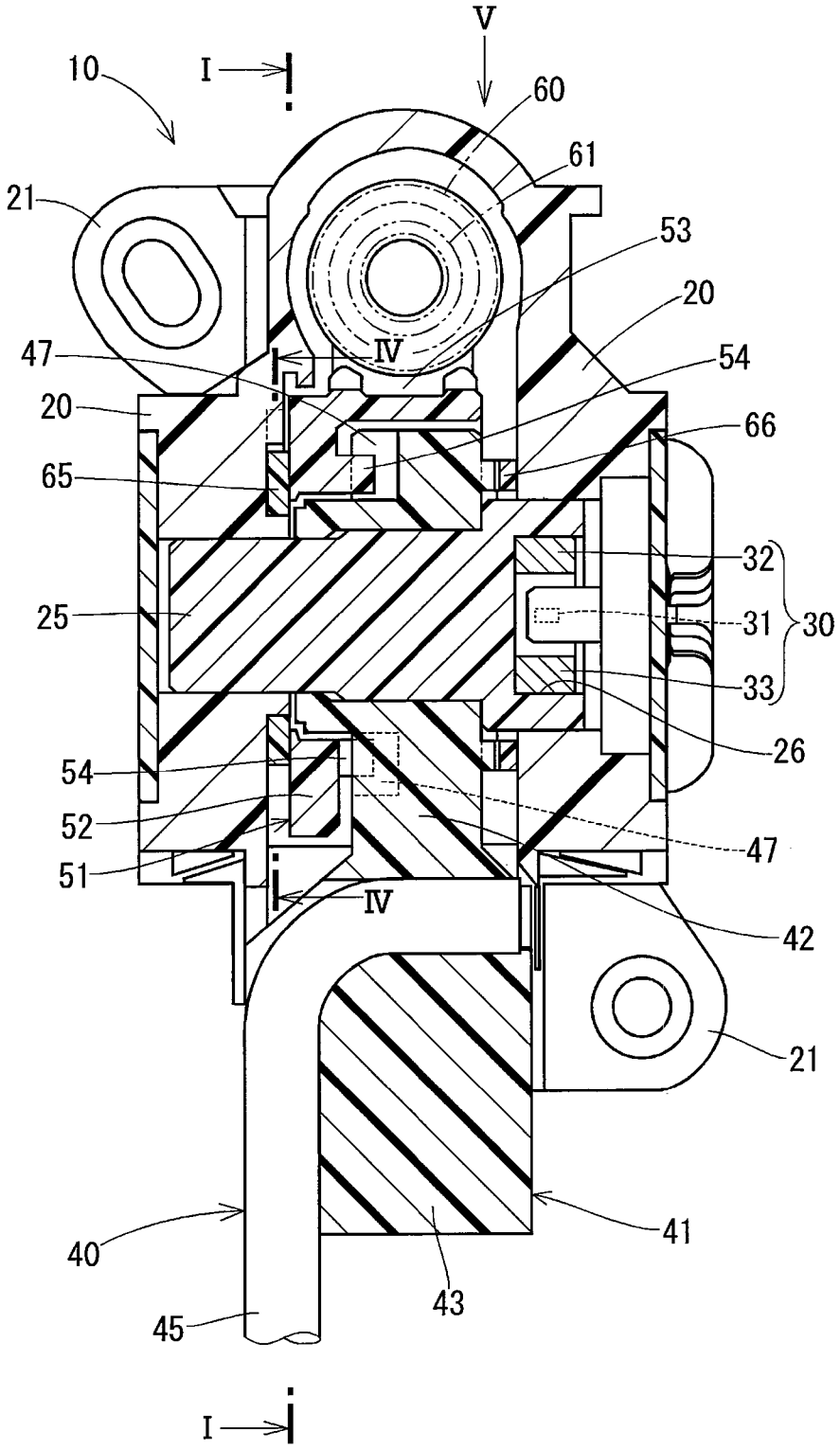
FIG. 2 is a sectional view taken along a line II-II in FIG. 1.
Figure 5:
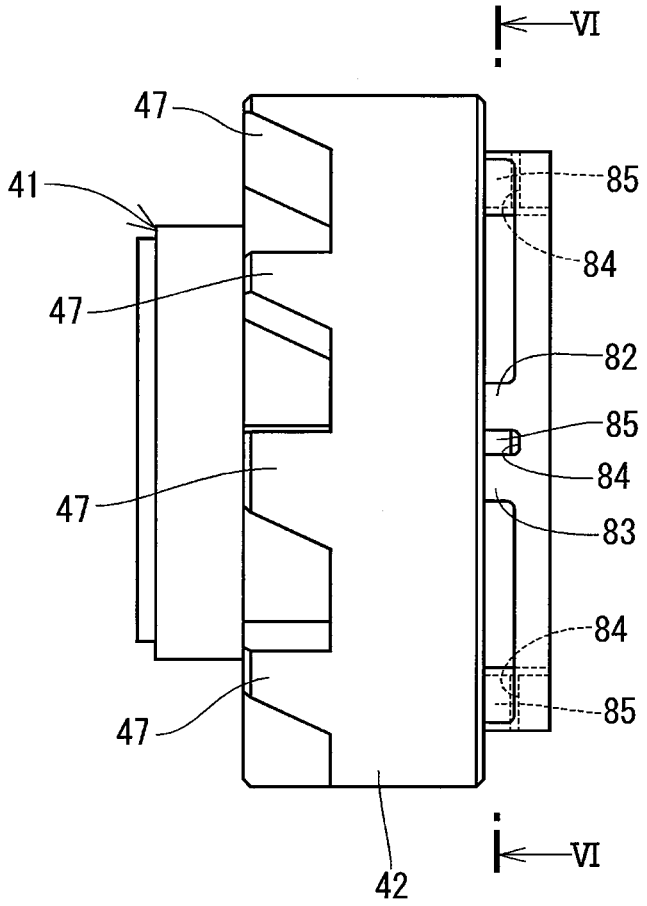
FIG. 5 is a view showing an operational member and a second frictional member of the accelerator device when being viewed from an arrow V in FIG. 2.
Figure 6:
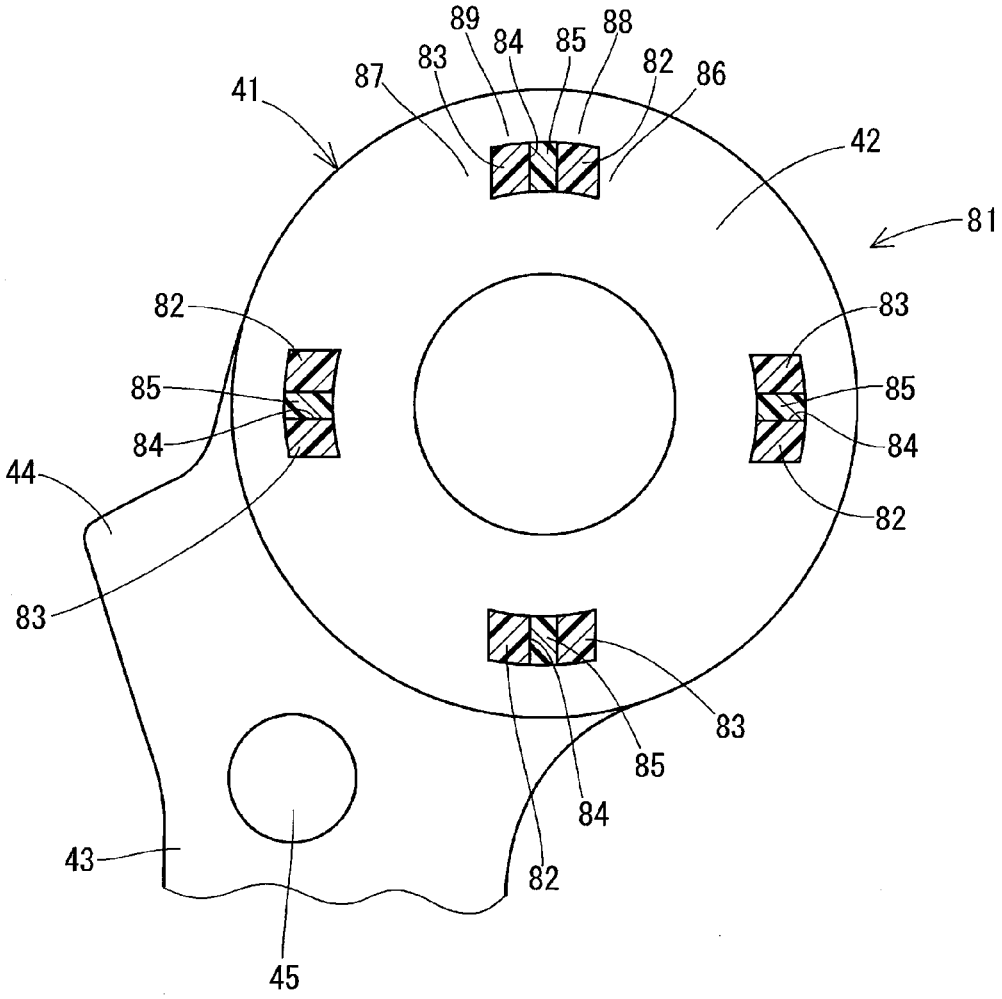
FIG. 6 is a sectional view taken along a line VI-VI in FIG. 5.

As shown in FIG. 2, FIG. 5, and FIG. 6, the second frictional member 66 has a slidable portion 81, a first latch portion 82, and a second latch portion 83. The slidable portion 81 is in an annular shape and is slidable relative to the housing 20. The first latch portion 82 and the second latch portion 83 are distant from each other in the rotational direction. The first latch portion 82 and the second latch portion 83 are closer to the pedal rotor 42 than the slidable portion 81 in the axial direction. The first latch portion 82 and the second latch portion 83 form a fitting groove (interspace) 84 therebetween. The fitting groove 84 is in a notch shape. In the present embodiment, the fitting groove 84 is formed at each of four positions at regular intervals in the rotational direction.

The pedal rotor 42 has four rotation restrictive projections 85 to restrict rotation. Each of the rotation restrictive projections 85 is fitted to the fitting groove 84, which is formed between the first latch portion 82 and the second latch portion 83 of the second frictional member 66. In the present embodiment, the projection 85 is press-fitted in the fitting groove 84. In the configuration including the second frictional member 66, the housing 20, and the accelerator pedal 40, the accelerator pedal 40 may function as a first member, and the housing 20 may function as a second member.

A clearance (first rotational clearance) 86 resides on the opposite side of the first latch portion 82 of the second frictional member 66 from the rotation restrictive projection 85. The clearance 86 allows expansion of the first latch portion 82 in the rotational direction. A clearance (second rotational clearance) 87 resides on the opposite side of the second latch portion 83 of the second frictional member 66 from the rotation restrictive projection 85. The clearance 87 allows expansion of the second latch portion 83 in the rotational direction. A clearance (first radial clearance) 88 resides on the outside of the first latch portion 82 of the second frictional member 66 in the radial direction. The clearance 88 allows expansion of the first latch portion 82 outward in the radial direction. A clearance (second radial clearance) 89 resides on the outside of the second latch portion 83 of the second frictional member 66 in the radial direction. The clearance 89 allows expansion of the second latch portion 83 outward in the radial direction. The clearances 86, 87, 88, and 89 are the same space and belong to a common clearance.

As described above, the accelerator device 10 according to the first embodiment includes the first frictional member 65, which has the first latch portion 71 and the second latch portion 72. The first latch portion 71 and the second latch portion 72 are arranged to be distant from each other in the rotational direction. The housing 20 has the rotation restrictive projection 74. The rotation restrictive projection 74 is fitted in the fitting groove 73, which is formed between the first latch portion 71 and the second latch portion 72 of the first frictional member 65. The second frictional member 66 includes the first latch portion 82 and the second latch portion 83. The first latch portion 82 and the second latch portion 83 are arranged to be distant from each other in the rotational direction. The pedal rotor 42 has the rotation restrictive projections 85. Each of the rotation restrictive projections 85 is fitted in the corresponding fitting groove 84, which is formed between the first latch portion 82 and the second latch portion 83 of the second frictional member 66.

When the accelerator device 10 is in an operation environment at high temperature, the first frictional member 65 and the second frictional member 66 may expand. Even in such a state, the present configuration enables to expand the fitting groove 73 of the first frictional member 65 and the fitting groove 84 of the second frictional member 66 in the rotational direction. Thus, the present configuration enables to restrict the first latch portion 71 and the second latch portion 72 of the first frictional member 65 from being urged onto the projection 74 of the housing 20. In addition, the present configuration enables to restrict the first latch portion 82 and the second latch portion 83 of the second frictional member 66 from being urged onto the projection 85 of the pedal rotor 42. Therefore, even when temperature of the operation environment of the accelerator device 10 increases and decreases repeatedly, the latch portions 71, 72, 82, and 83 can be protected from deformation. Thus, the present configuration enables to maintain an operational feeling of the accelerator pedal 40.

Second Embodiment

Figure 7:
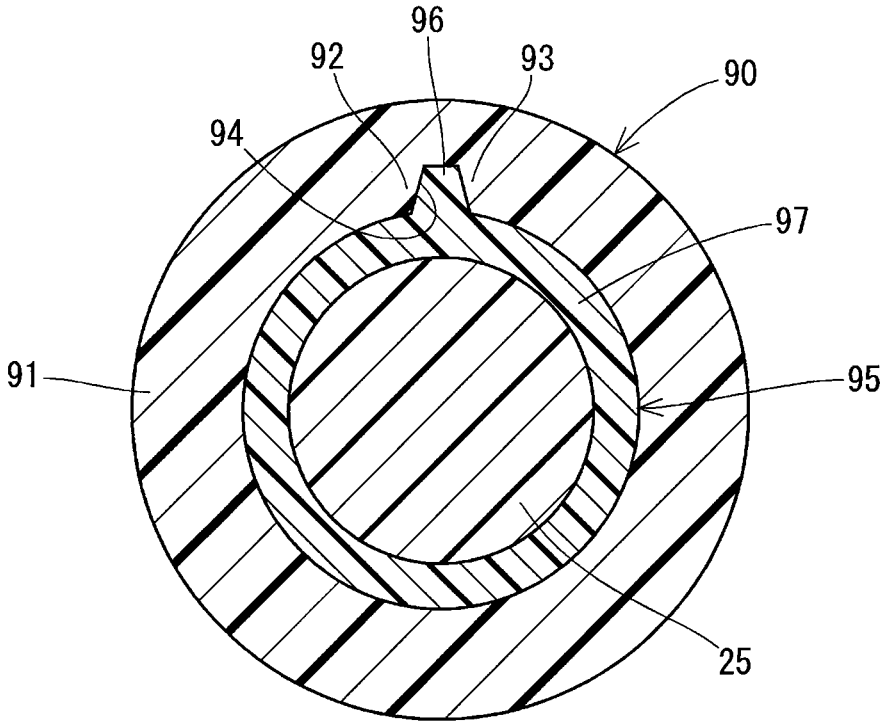
FIG. 7 is a sectional view showing a first frictional member of an accelerator device according to a second embodiment of the present disclosure.

An accelerator device according to a second embodiment of the present disclosure will be described with reference to FIG. 7. As shown in FIG. 7, a first frictional member 90 includes a slidable portion 91, a first latch portion 92, and a second latch portion 93. The slidable portion 91 is in an annular shape and is slidable relative to a return rotor. The first latch portion 92 and the second latch portion 93 arranged to be distant from each other in the rotational direction. The first latch portion 92 and the second latch portion 93 are located on the inside of the slidable portion 91 in the radial direction. The first latch portion 92 and the second latch portion 93 form a fitting groove (interspace) 94 therebetween. The fitting groove 94 is in a notch shape.

A housing (support member) 95 has a rotation restrictive projection 96. The rotation restrictive projection 96 is fitted in the fitting groove 94, which is formed between the first latch portion 92 and the second latch portion 93 of the first frictional member 90. In the present embodiment, the projection 96 is press-fitted in the fitting groove 94. The housing 95 has a latch projected portion 97, which is in an annular shape. The latch projected portion 97 is fitted in the first frictional member 90 and is located on the inside of the first frictional member 90 in the radial direction. In the configuration including the first frictional member 90, the housing 95, and the accelerator pedal, the housing 95 may function as a first member, and the accelerator pedal may function as a second member.

According to the second embodiment, even when the first frictional member 90 expands in an operation environment at high temperature, the first latch portion 92 and the second latch portion 93 of the first frictional member 90 can be restricted from being urged onto the projection 96 of the housing 95. Therefore, even when temperature of the operation environment of the accelerator device increases and decreases repeatedly, the latch portions 92 and 93 can be protected from deformation. Thus, similarly to the first embodiment, the present configuration enables to maintain an operational feeling of the accelerator pedal.

Other Embodiment

According to another embodiment of the present disclosure, the first frictional member may be mounted to the return rotor. The second frictional member may be mounted to the housing.

According to another embodiment of the present disclosure, the inside of the first latch portion of the first frictional member in the radial direction and the inside of the second latch portion in the radial direction may be connected to each other. In addition, the outside of the first latch portion in the radial direction and the outside of the second latch portion in the radial direction may be connected to each other. In the present configuration, the first latch portion and the second latch portion of the first frictional member may form a hole therebetween, and the hole may extend in the axial direction. In the present configuration, the projection, which forms the first member, may be fitted in the hole.

According to another embodiment of the present disclosure, in the second frictional member, the inside of the first latch portion in the radial direction and the inside of the second latch portion in the radial direction may be connected to each other. In addition, the outside of the first latch portion in the radial direction and the outside of the second latch portion in the radial direction may be connected to each other. In the present configuration of the second frictional member, the first latch portion and the second latch portion may form a hole therebetween, and the hole may extend in the axial direction. In the present configuration, the projection, which forms the first member, may be fitted in the hole.

According to another embodiment of the present disclosure, the resistance application unit may have a configuration other than the inclined teeth.

The accelerator device according to the present disclosure includes the support member attachable to the vehicle body. The accelerator device further includes the accelerator pedal supported by the support member and rotatable from the full close position to the full open position. The accelerator device further includes the biasing member configured to bias the accelerator pedal to the full close position. The accelerator device further includes the frictional member located between the support member and the accelerator pedal. The accelerator device further includes the resistance application unit configured to apply rotational resistance to the accelerator pedal. The frictional member is mounted to a first member and is frictionally slidable on a second member. The first member is one of the support member and the accelerator pedal. The second member is the other of the support member and the accelerator pedal. The resistance application unit is configured, as the rotation angle of the accelerator pedal increases from the full close position, to increase the frictional force between the second member and the frictional member and to increase the rotational resistance applied from the frictional member to the accelerator pedal.

In the above-described example, the frictional member forms the first latch portion and the second latch portion, and the first member forms the projection. The first latch portion and the second latch portion of the frictional member form a interspace in the rotational direction. The projection of the first member is fitted between the first latch portion and second latch portion of the frictional member to restrict rotation.

When the accelerator device is in the operation environment at high temperature, the frictional member may expand. At this time, the first latch portion and the second latch portion of the frictional member also expand, such that the distance between the first latch portion and the second latch portion becomes large. Consequently, the present configuration enables to restrict the first latch portion and the second latch portion from being urged onto the projection of the first member. Therefore, even when temperature of the operation environment of the accelerator device increases and decreases repeatedly, the first latch portion and the second latch portion of the frictional member can be protected from deformation. Thus, the present configuration enables to maintain the operational feeling of the accelerator pedal.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. An accelerator device comprising:

a support member attachable to a vehicle body;

an accelerator pedal supported by the support member and rotatable from a full close position to a full open position;

a biasing member configured to bias the accelerator pedal to the full close position;

a frictional member located between a first member and a second member, the frictional member mounted to the first member and slidable on the second member, wherein the first member is one of the support member and the accelerator pedal, and the second member is an other of the support member and the accelerator pedal; and a resistance application unit configured, as a rotation angle of the accelerator pedal increases from the full close position, to increase a frictional force between the second member and the frictional member and to increase a rotational resistance applied from the frictional member to the accelerator pedal, wherein the frictional member includes a slidable portion, a first latch portion, and a second latch portion, the slidable portion is slidable on the second member, the first latch portion and the second latch portion define an interspace therebetween in a rotational direction, and the first member includes a rotation restrictive projection fitted between the first latch portion and the second latch portion.

2. The accelerator device according to claim 1, wherein the rotation restrictive projection is press-fitted between the first latch portion and the second latch portion.

3. The accelerator device according to claim 1, wherein a first rotational clearance resides on an opposite side of the first latch portion from the rotation restrictive projection, the first rotational clearance configured to allow expansion of the first latch portion in the rotational direction, and a second rotational clearance resides on an opposite side of the second latch portion from the rotation restrictive projection, the second rotational clearance configured to allow expansion of the second latch portion in the rotational direction.

4. The accelerator device according to claim 3, wherein a first radial clearance resides on an outside of the first latch portion in a radial direction, the first radial clearance configured to allow expansion of the first latch portion outward in the radial direction, and a second radial clearance resides on an outside of the second latch portion in the radial direction, the second radial clearance configured to allow expansion of the second latch portion outward in the radial direction.

5. The accelerator device according to claim 1, wherein the slidable portion is in an annular shape, and the first member includes a latch projected portion fitted to the slidable portion and located on an inside of the slidable portion in a radial direction.

6. The accelerator device according to claim 5, wherein the latch projected portion is press-fitted in the slidable portion.

* * * * *